US005815963A

United States Patent [19]

Rauch et al.

[11] Patent Number: 5,815,963

[45] Date of Patent: Oct. 6, 1998

[54] APPARATUS AND PROCESS FOR FEEDING LAUNDRY ITEMS TO A PROCESSING UNIT

[75] Inventors: Martin Rauch, Hasle-Rueggsau; Jorn Munch Jensen, Bern, both of Switzerland

[73] Assignee: Jensen AG Burgdorf, Burgdorf, Switzerland

[21] Appl. No.: 813,596

[22] Filed: Mar. 7, 1997

[30] Foreign Application Priority Data

Mar. 8, 1996 [CH] Switzerland ..... 00610/96

[51] Int. Cl.[6] ..... D06F 67/04

[52] U.S. Cl. ..... 38/143

[58] Field of Search ..... 38/143; 271/268

[56] References Cited

U.S. PATENT DOCUMENTS

| | | | |
|---|---|---|---|
| 4,106,227 | 8/1978 | Allen et al. . | |
| 5,333,402 | 8/1994 | Weir | 38/143 |
| 5,416,991 | 5/1995 | Jensen | 38/143 |

FOREIGN PATENT DOCUMENTS

| | | | |
|---|---|---|---|
| 0 053 562 | 6/1982 | European Pat. Off. . | |
| 33 20 404 | 12/1984 | Germany . | |
| 42 02 380 | 1/1993 | Germany . | |
| 2221226 | 1/1990 | United Kingdom | 38/143 |

*Primary Examiner*—Ismael Izaguirre
*Attorney, Agent, or Firm*—Oblon, Spivak, McClelland, Maier & Neustadt, P.C.

[57] ABSTRACT

A laundry item is seized by an inner, first clamp (14) and an outer second clamp (14') of a clamp pair (13*a,* 13*b*) of a spreading-out device (12) and is spread out by displacing the first clamp (14) by means of a belt (15*a,* 15*b*) until the second clamp (14') is drawn out of its initial position, which is detected by a position sensor (19*a,* 19*b*). After the displacement speed has been reduced and the second clamp (14') has caught up slightly, with the result that the leading edge of the laundry item is relieved of tensioning to some extent, the second clamp (14') is coupled to the belt (15*a,* 15*b*). When the first clamp reaches a synchronization sensor (20*a,* 20*b*) which is offset with respect to the position sensor (19*a,* 19*b*), the width of the laundry item is determined from the difference between the clamp positions. In accordance with this width and the occupancy, monitored by sensors, of a feed conveyor which adjoins the spreading-out device (12), the laundry item is centered with respect to one half of the track of the feed conveyor, or with respect to the entire track of the feed conveyor and set down on said conveyor.

19 Claims, 6 Drawing Sheets

APPARATUS AND PROCESS FOR FEEDING LAUNDRY ITEMS TO A PROCESSING UNIT

BACKGROUND OF THE INVENTION

1. Field of the Invention

The present invention relates to an apparatus and process for feeding laundry items to a processing unit.

2. Description of the Related Art

Processes and feed apparatuses of the type mentioned above used to spread out items of laundry and to direct the latter in this form to a mangle, folding machine or the like in order to be processed. The JENSEN JENFEED CENTRAFIN is a known feed apparatus which can be switched between single-track operation for large items of laundry and multi-track operation for simultaneously processing two smaller items of laundry. For introduction of the laundry items via clamps, however, the laundry items have to be pre-sorted since the clamps must center each laundry item either with respect to the entire track width of a feed conveyor or with respect to one half of the track width.

The same applies to the apparatus known from DE-A-33 20 404, which has stops which can be changed over for centering with respect to either the entire track or a part of the track.

It is also known to design feed apparatuses which determine the width of the laundry items. Thus, DE-A-42 02 380 discloses a lever which is arranged beneath the outer clamp of a clamp pair, with the leading edge of the laundry item passing beneath it. Thus, when the laundry item is pulled taut, the lever is raised and this initiates a calculation of the width of the laundry item, i.e., of the length of its leading edge, from the position of the lever and the position of the inner clamp, using Pythagoras' theorem. The equipment required, however, complicates the feed apparatus considerably and also makes it more difficult to spread out the laundry item. The calculation required necessitates special equipment and can cause undesirable delays.

A simpler way of determining the width of the laundry item is known from EP-A-0 053 562. In the case of this general type of apparatus, with two clamp pairs arranged laterally, the position of the inner clamp is monitored while a switch checks the outer clamp in order to ascertain whether it is located in an initial position. Once the laundry item has been spread out by the movement of the inner clamp, the outer clamp is drawn out of its initial position. The width of the laundry item is determined from the position of the inner clamp at this time.

This procedure has the disadvantage that, at the moment at which the movement of the outer clamp commences, the leading edge of the laundry item is very highly tensioned and has usually been stretched to some extent. If the outer clamp is immediately moved parallel to the inner clamp, as is the case with the apparatus of this general type, then the laundry item is set down and processed further in this state, as a result of which it is subjected to pronounced mechanical strain. However, if the stretching were discontinued, then the measurement of the width would be inaccurate.

SUMMARY OF THE INVENTION

It is an object of the invention to provide a process in which the movements of the clamps are controlled in such a way that each laundry item is set down in accordance with its width and the space available, so that there is no overlapping and a high throughput is achieved.

It is a further object of the invention to provide a feed apparatus which, using simple means, makes it possible in a quick and reliable manner, to determine the width of an laundry item in the state in which it is set down on the feed conveyor, without this laundry item having to be set down with its leading edge in a highly tensioned, stretched state.

The invention provides a process in which laundry items which are of different sizes and are aligned in different ways can be fed to a processing apparatus without pre-sorting and with a high throughput. Nevertheless, operation is very simple and does not require any special attention.

In the case of the feed apparatus according to the invention, the necessary operation of determining the width of a laundry item is achieved by simple, cost-effective means and without interfering with the spreading of the laundry item. The forces acting on the leading edge of the laundry item are easily controllable and the laundry item is not subjected to mechanical strain to any great extent.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1A:
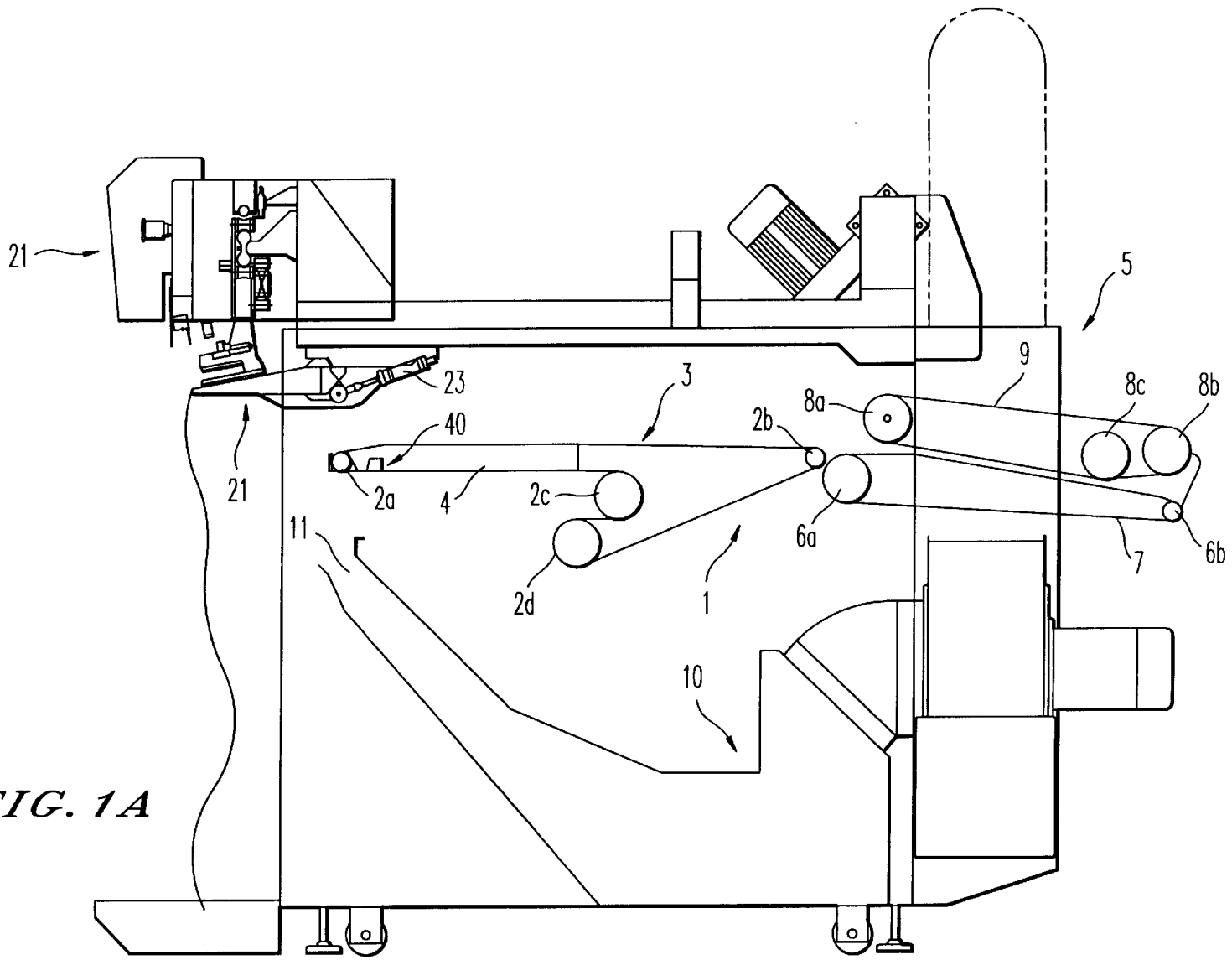
FIG. 1*a* is a schematic side view of the feed apparatus according to the invention during a first phase of the process according to the invention.

The feed apparatus of FIG. 1*a* includes a feed conveyor 1 with a first belt conveyor 3 which comprises a series of perforated conveying belts arranged one beside the other and guided over rollers 2*a*–2*d*. A suction chamber 4 connected to a suction line (not illustrated) is arranged in the vicinity of the front edge of the belt conveyor 3. Chamber 4 is open on the upper side over which the conveying belts are guided. Two upwardly directed, e.g., optical, sensors 40 are arranged one beside the other in chamber 4 along a monitoring line for monitoring the extent to which the feed conveyor 1 is occupied by laundry items. Each sensor 40 is arranged approximately in the center of one half of the track of the feed conveyor (not illustrated).

The first belt conveyor 3 is adjoined by a second belt conveyor 5 with bottom belts 7 which are guided over two rollers 6*a*–6*b,* and top belts 9 which are guided over three rollers 8*a*–8*c.* Arranged beneath the first belt conveyor 3 is a suction device 10 with a suction slot 11 located beneath the front edge of said belt conveyor 3.

Figure 2A:
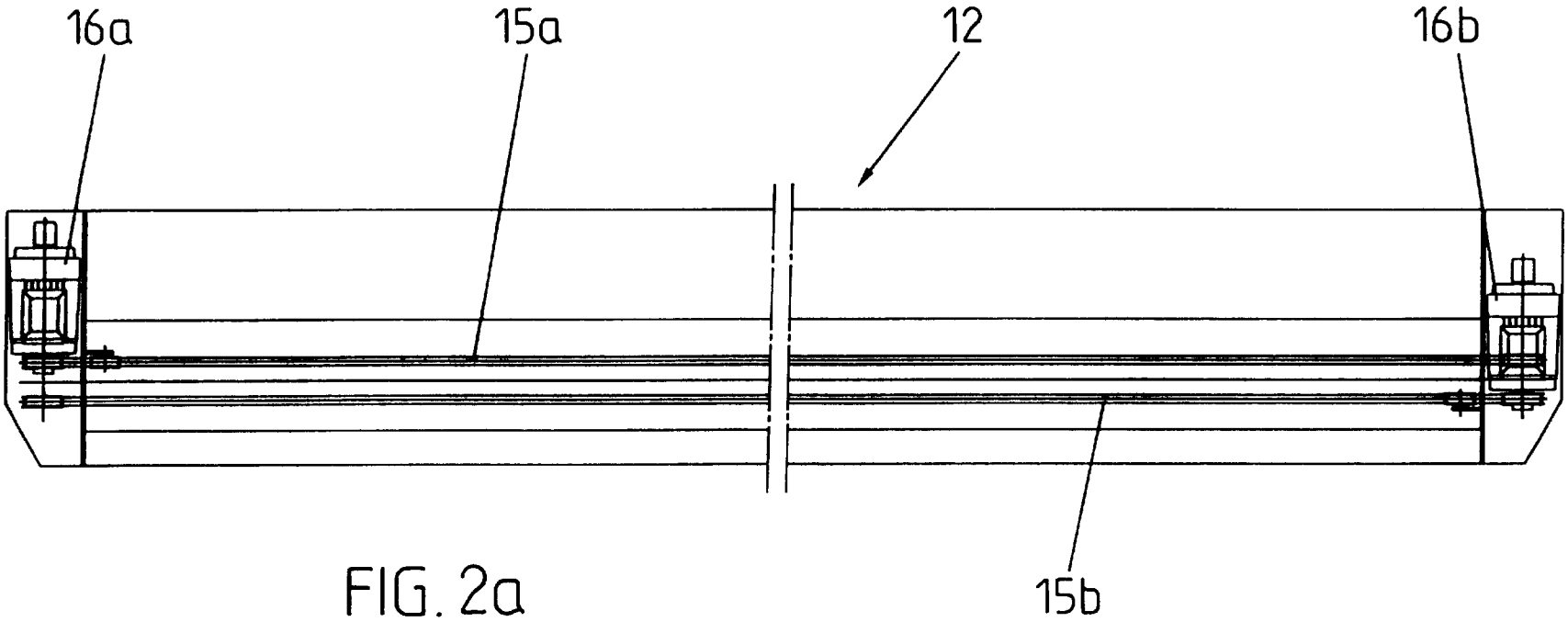
FIG. 2*a* is a plan view of the spreading-out device of the feed apparatus according to the invention.
Figure 2B:
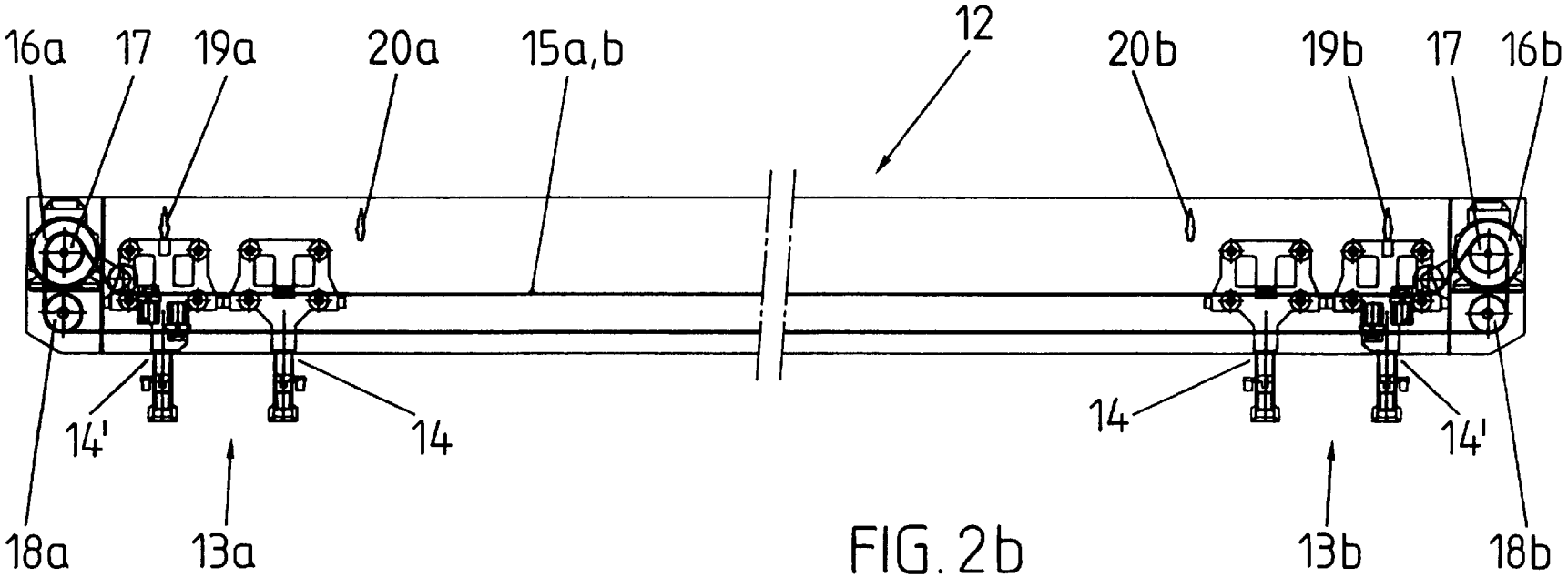
FIG. 2*b* is a front view of the spreading-out device according to FIG. 2*a;*

Arranged upstream of the feed conveyor 1, parallel to the front edge of the first belt conveyor 3, is a spreading-out device 12 (see FIGS. 2*a*–2*b;* covering parts and other parts have been left out) which has (FIG. 2*b*) two pairs 13*a*–13*b* of pneumatically actuated clamps which can be displaced along a displacement section transversely with respect to the conveying direction, each clamp pair comprising an inner, first clamp 14 and an outer, second clamp 14' (left out in FIG. 2*a*). The left-hand clamp pair 13*a* is driven via a toothed belt 15*a* by an electric motor 16*a,* the belt 15*a* being guided as an elongate enveloping member over the drive wheel 17 of electric motor 16*a.* The belt 15*a* also runs over a rotary encoder 18*a* which thus monitors the position of the first clamp 14 of the left-hand clamp pair 13*a,* said first clamp being fixedly connected to the toothed belt 15*a.* A position sensor 19*a,* which may be an inductive proximity switch, is located at an initial position of the second clamp 14' and monitors whether the second clamp 14' is or is not located in the initial position. Offset inwards to some extent—preferably by not more than 50 cm—is a similar synchronization sensor 20*a* which registers the passage of the second clamp 14'.

The drive of the right-hand clamp pair 13*b* is of the same construction, having a toothed belt 15*b,* an electric motor 16*b,* a rotary encoder 18*b,* a position sensor 19*b* and a synchronization sensor 20*b.*

Provided downstream of the spreading-out device 12 (FIGS. 1*a*–1*b*) is a suction type set-down strip 21 which extends over the entire width of the feed conveyor 1 and has a suction chamber 22 which is perforated on the upper side and is connected to a suction line via a switchable valve. The set-down strip 21 is divided centrally into two halves which can be coupled to one another.

Figure 1B:
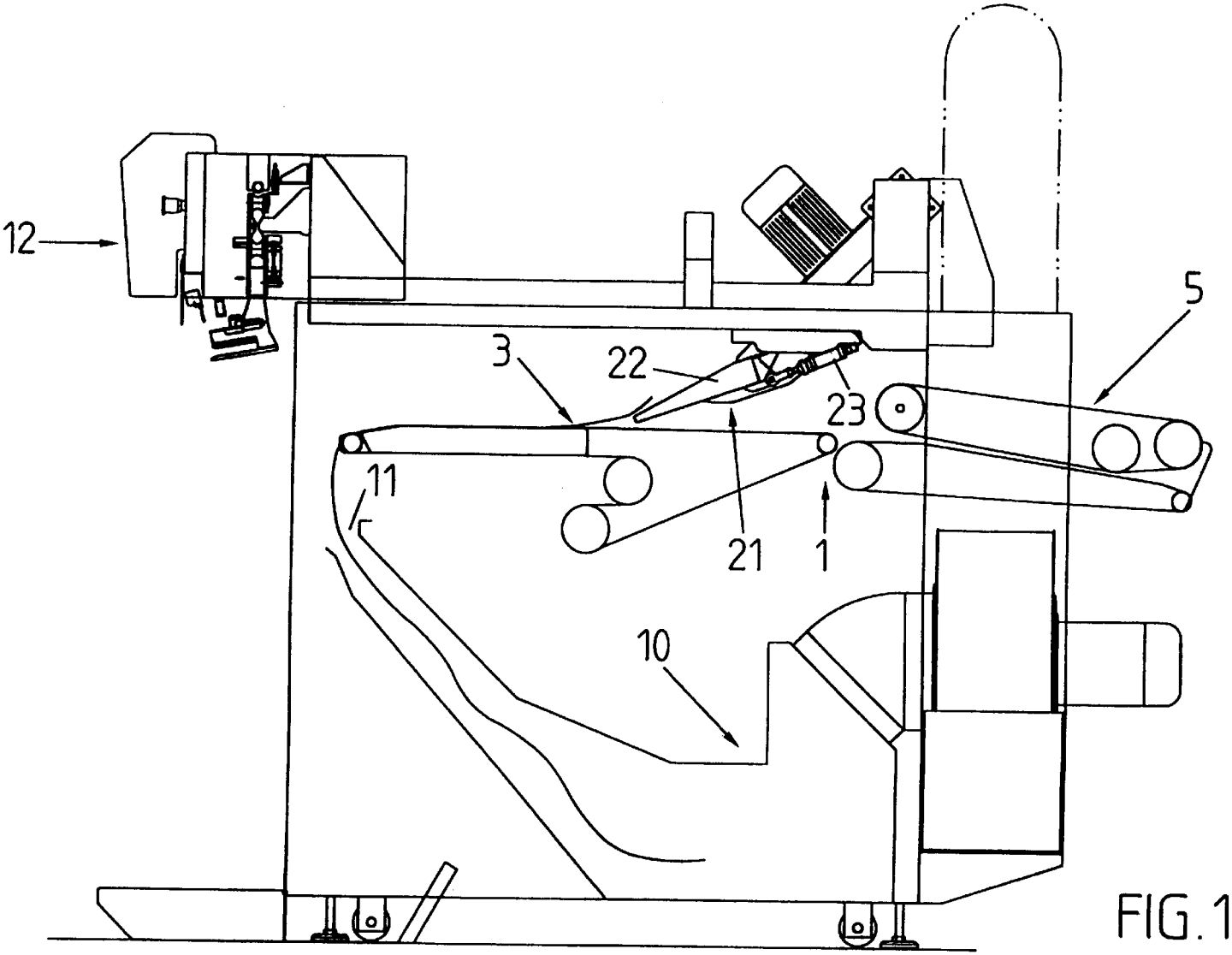
FIG. 1*b* is a side view corresponding to FIG. 1*a* during a second phase of the process according to the invention.

The set-down strip 21 as a whole, or each of its halves individually, can be displaced in the conveying direction between a front, receiving position which is shown in FIG. 1*a,* and a rear, set-down position which can be seen from FIG. 1*b* and in which it is located downstream of the suction chamber 4 of the first belt conveyor 3. At the same time, it can be pivoted to a limited extent around a horizontal axis by means of a pneumatic cylinder 23.

Figure 3A:
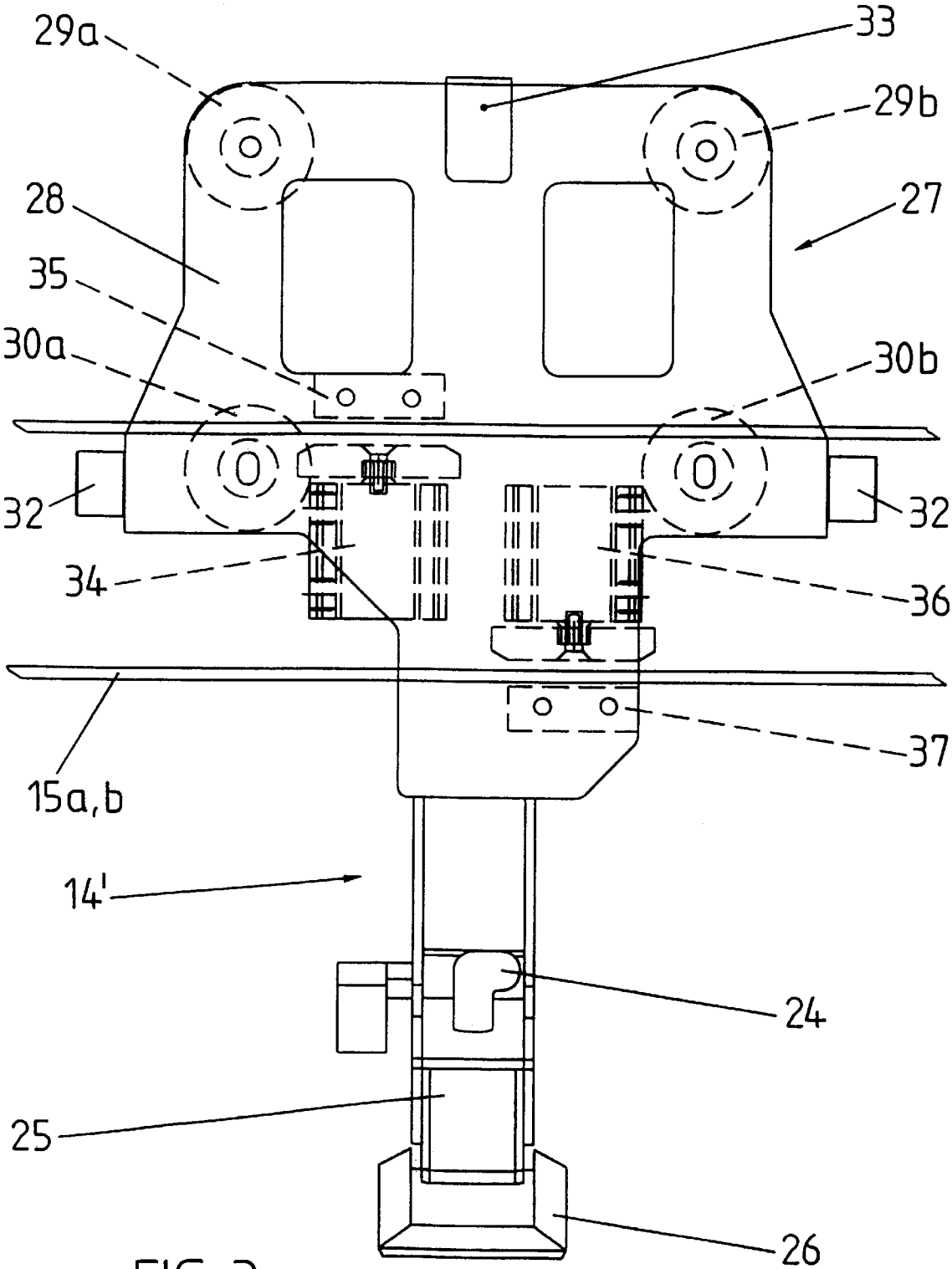
FIG. 3*a* is a front view of a clamp of the spreading-out device according to FIGS. 2*a* and 2*b.
Figure 3B:
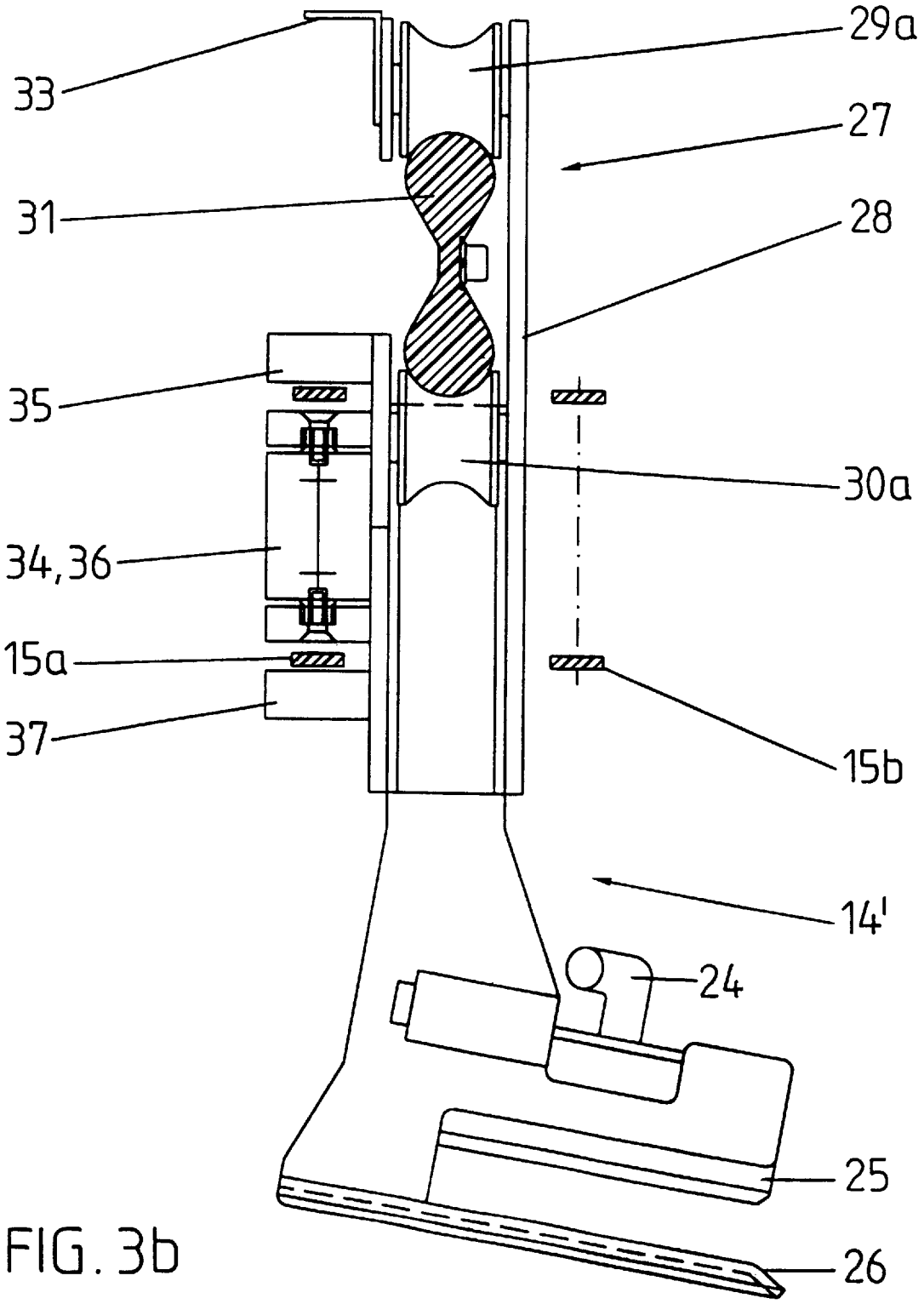
* and FIG. 3*b* is a side view of the clamp according to FIG. 3*a*.

As can best be seen from FIGS. 3*a*–3*b,* which illustrate the second clamp 14' of the left-hand clamp pair 13*a,* said second clamp comprises a top clamping jaw 25 which can be actuated pneumatically via a connection 24, and a fixed, bottom counter-jaw 26, these jaws being suspended on a carriage 27. A base plate 28 of the carriage 27 bears a top roller pair 29*a*–29*b* (the parts located behind the base plate 28 are illustrated by solid lines in FIG. 2*b*) and a bottom roller pair 30*a*–30*b.* The top roller pair are in rolling contact from above, and the bottom roller pair are in rolling contact from beneath, with a rail 31 (FIG. 3*b*) which extends over the entire width of the spreading-out device. Stops 32 (FIG. 3*a*) are fastened on both sides of the base plate 28 and a contact angle piece 33 is fastened on the top border of the base plate 28, the position sensor 19*a* and the synchronization sensor 20*a* (FIG. 2*b*) sensing said contact angle piece 33.

The first clamp 14 and the second clamp 14' are of essentially the same construction, except that the first clamp 14 is connected fixedly to the top section of the toothed belt 15*a.* The second clamp 14' can be selectively coupled to the same. For this purpose, the base plate 28 has a coupling device in the form of a first pneumatic cylinder 34 on whose piston there is fastened a clamping part which can bear against an abutment 35 to clamp the toothed belt 15*a* thereagainst. A further coupling device, which is of the same construction, with a pneumatic cylinder 36 and an abutment 37, can be used to couple the second clamp 14' to the bottom section of the toothed belt 15*a.* It is also possible for the two clamps 14–14' to be moved in opposite directions, if desired.

The process according to the invention will be explained with reference to the comparatively simple cases of the feed apparatus being occupied either with one wide laundry item or with two narrow laundry items, each requiring no more than half of the width of the feed conveyor 1.

A laundry item is fed, e.g., manually, to the clamps 14–14' of the left-hand clamp pair 13*a,* as a result of which the corners delimiting a leading edge of the laundry item are introduced into the clamps 14–14' and automatically clamped by the same. It is then checked as to whether the left-hand sensor of the two sensors 40 arranged in the suction chamber 4 is registering occupancy of the left-hand half of the track of the feed conveyor. If this is the case, it means that the first clamp 14 is in its initial position. As soon as the sensor 40 registers that there is no such occupancy, the electric motor 16*a* is set in motion and displaces the first clamp 14 quickly to the right. When the right-hand sensor indicates occupancy of the right-hand half of the track of the feed conveyor, it means that the first clamp has been displaced to the boundary of the left-hand half of said track.

However, if the laundry item is narrow then before this position is reached the leading edge of the laundry item is tensioned and the second clamp 14' is drawn out of its initial position counter to a retaining force, which is sensed by the position sensor 19*a.* Thereafter, the speed of the belt 15*a,* and thus of the first clamp 14, is immediately reduced, with the result that the second clamp 14' catches up to some extent and the leading edge of the laundry item is relieved of tensioning.

The pneumatic cylinder 34 is then actuated to clamp the second clamp 14', and the speed of the belt 15*a* and thus of the clamps 14–14' is increased. When the second clamp 14' reaches the synchronization sensor 20*a,* the width of the laundry item with the leading edge relieved of tension is determined from the difference between the position of the first clamp 14 and of that of the second clamp 14', which coincides with the position of the synchronization sensor 20*a.* If the laundry item requires only the left-hand half of the track of the feed conveyor, it is centered with respect to the same and set down on the first belt conveyor 3.

In contrast, if the first clamp 14 reaches the boundary of the left-hand half of the track of the feed conveyor without the position sensor 19*a* having responded or if the determination of the width of the laundry item reveals that this width extends beyond the width of the left-hand half of said track, then the first clamp 14 or the clamp pair 13*a,* respectively, is stopped until the right-hand sensor no longer registers occupancy. The laundry item is then centered with respect to the entire track of the feed conveyor and set down on the first belt conveyor 3.

If the right-hand half of the track of the feed conveyor is not occupied, then it is also possible for the first clamp 14 to be displaced beyond the boundary of the left-hand half of the track and for the laundry item to be centered with respect to the entire track of the feed conveyor and set down.

For the setting-down operation, the clamps 14–14' are released and open outwards, with the result that the leading region of the laundry item comes to rest on the set-down strip 21, which is located in its front, receiving position (FIG. 1*a*), where the suction chamber 22 retains and secures it by suction. Thereafter, either the set-down strip 21 or the left-hand half of the same is displaced at a speed which is greater than the conveying speed of the first belt conveyor 3 into its rear, set-down position (FIG. 1*b*) and the suction chamber 22 is pivoted towards the first belt conveyor 3. Finally, suction is released, with the result that the leading edge of the laundry item drops onto the belt conveyor 3 at a set-down location.

The difference in the speeds of the first belt conveyor 3 and of the set-down strip 21 is allowed for, in the determination of the time at which sufficient space is available on said belt conveyor 3, by a fixed delay. At the same time, the trailing part of the laundry item is sucked in at the suction slot 11 by the suction device 10. The advancement of the leading end of the laundry item at higher speed and the action of the negative-pressure chamber 4 of the first belt conveyor 3 and of the suction device 10 have the effect of stretching out the laundry item, and it is thus ensured that the latter does not fold transversely. The laundry item is fed by the first belt conveyor 3 to the second belt conveyor 5, and by the latter to a processing unit, e.g., a mangle or a folding machine, while the set-down strip 21 is quickly displaced into its receiving position again.

The above described procedure presents only a comparatively simple example which has particularly low requirements as far as outlay in terms of apparatus and control. However, it is possible to optimize the occupancy further in relation to the throughput. For example, continuous monitoring of the state of occupancy and changes therein, and intermediate storage of the respective state, are possible and can be used, in accordance with the determination of the width of the laundry item, to determine an available space of sufficient size for the laundry item which is nearest, for example, the initial position of the respective clamp pair, and to displace the clamps into the region of said space.

The number of laundry items set down one beside the other so as to overlap lengthwise is, in principal, limited only by the width-related resolution with which the occupancy of the first belt conveyor 3 is monitored. This can be increased by arranging a larger number of sensors along the monitoring line. Or, for example, adjacent sensors may be spaced apart by a distance which is just under the minimum expected width of laundry items; the positions of the clamps as the laundry item is set down are used for more precise position determination and the sensors serve only for monitoring the length.

In addition, it is possible to only monitor the clamp positions during the setting-down operation and to make assumptions on the maximum length of the laundry items—in absolute terms or in dependence on the respective width—and to dispense with sensors.

It is also possible for the laundry items to be set down only on specific part-tracks, or combinations of adjacent part-tracks, of the feed conveyor or to be positioned, e.g. centered, with respect to the same, for example in view of the following processing.

In all cases, it is always necessary to determine the width of the laundry item—with a greater or lesser degree of accuracy depending on the circumstances. An arrangement such as that described above with a position-measuring system for determining the position of the clamps is only necessary for the second clamp to be monitored by a sensor in order to ascertain whether it is located in a specific position. Such an arrangement is particularly suitable for a fairly accurate determination of the width since it is very simple, both in terms of apparatus and as far as the evaluation of the signals is concerned, and does not have any adverse effects on the spreading-out operation.

Such an arrangement for determining the width of the laundry item may also be used within the context of known processes, in which, for example, the laundry items are only centered with respect to the entire track of the feed conveyor. The retaining force with which the second clamp is secured in the initial position can be set, for example, in accordance with the nature of the laundry items and/or can be controlled in accordance with the width of said laundry items.

Obviously, numerous modifications and variations of the present invention are possible in light of the above teachings. It is therefore to be understood that the invention may be practiced otherwise than as specifically described herein.

We claim:

1. A process for feeding laundry items to a processing unit by means of a feed conveyor and a spreading-out device arranged upstream of said feed conveyor, as seen in the conveying direction, the spreading-out device having at least one clamp pair comprising clamps which can be displaced transversely with respect to the conveying direction, the process comprising the steps of:

seizing two adjacent corners of a leading edge of an laundry item by the clamps of the clamp pair in an initial position of the clamps;

moving the clamps apart from one another until a laundry-item leading edge located between the adjacent corners has been spread out;

checking the occupancy of the feed conveyor;

establishing the width of the laundry item in the direction of the displacement section as the laundry item is spread out;

seeking an occupancy space in the feed conveyor, the occupancy space at least corresponding to the width of the laundry item;

after the occupancy space has been located, displacing the clamps to the occupancy space with the laundry item in a spread-out state; and opening the clamps to release and set-down the laundry item onto the feed conveyor.

2. The process according to claim 1, wherein when a plurality of occupancy spaces are present, the clamps are positioned within the occupancy space which is located nearest the initial position thereof.

3. The process according to claim 2 wherein said step of seeking an occupancy space comprises:

displacing a first clamp of the clamp pair until a first occupancy space is reached; and continuing to displace said clamp, as long as the feed conveyor is not occupied, until the distance of the first clamp from said first occupancy space corresponds at least to the width of the laundry item.

4. The process according to claim 1, wherein before the step of setting down the laundry item onto the feed conveyor, the leading edge of the laundry item is advanced to a set-down location of said conveyor at a speed which exceeds a conveying speed of the feed conveyor.

5. The process according to claim 4, wherein said monitoring step is performed at a fixed feed-conveyor position located upstream of the set-down location.

6. The process according to claim 1, including the step of continuously monitoring the occupancy of the feed conveyor over the entire width of said conveyor.

7. The process according to claim 1 wherein the occupancy space has a width sufficient for the laundry item and is located within a range of displacement of the clamp pair.

8. The process according to claim 1 wherein only a first clamp of the clamp pair is displaced until the leading edge has been spread out, after which a second clamp of the clamp pair is drawn out of its initial position counter to a retaining force.

9. The process according to claim 8 wherein the width of the laundry item is determined from the difference between the positions of the first clamp and the second clamp when the second clamp reaches a position which is offset with respect to its initial position.

10. A feed apparatus for feeding laundry items to a processing unit, comprising:

a feed conveyor;

a spreading-out device with at least one clamp pair comprising clamps for seizing the corners of an laundry item;

a displacement section arranged upstream of the feed conveyor in the conveying direction, said displacement section extending transversely with respect to a conveying direction and having a position measuring system for monitoring the position of at least a first clamp of each clamp pair;

drive means for displacing said clamps along said displacement section, wherein for each clamp pair, the spreading-out device has a synchronization sensor for monitoring the position of a second clamp of the clamp pair, in order to ascertain whether said second clamp is located at a predetermined position offset with respect to its initial position, and wherein said second clamp is selectively disengaged or engaged from said drive means.

11. The feed apparatus according to claim 10 wherein for each clamp pair, the spreading-out device has a position sensor which monitors the second clamp in order to ascertain whether it is located in the initial position.

12. A feed apparatus for feeding laundry items to a processing unit, comprising:

a feed conveyor;

a spreading-out device with at least one clamp pair comprising clamps for seizing the corners of an laundry item;

a displacement section arranged upstream of the feed conveyor in the conveying direction, said displacement section extending transversely with respect to a conveying direction and having a position measuring system for monitoring the position of at least a first clamp of each clamp pair; and drive means for displacing said clamps along said displacement section;

wherein for each clamp pair, the spreading-out device has a synchronization sensor for monitoring the position of a second clamp of the clamp pair, in order to ascertain whether said second clamp is located at a predetermined position offset with respect to its initial position, and wherein said second clamp is selectively disengaged or engaged from said drive means;

wherein for each clamp pair, the spreading-out device has a position sensor which monitors the second clamp in order to ascertain whether it is located in the initial position and wherein the synchronization sensor and the position sensor are proximity switches.

13. A feed apparatus for feeding laundry items to a processing unit, comprising:

a feed conveyor;

a spreading-out device with at least one clamp pair comprising clamps for seizing the corners of an laundry item;

a displacement section arranged upstream of the feed conveyor in the conveying direction, said displacement section extending transversely with respect to a conveying direction and having a position measuring system for monitoring the position of at least a first clamp of each clamp pair;

drive means for displacing said clamps along said displacement section;

a monitoring device for monitoring the occupancy of the feed conveyor and comprising means for detecting, in at least one position, the occupancy of the feed conveyor at any time along a monitoring line running transversely with respect to the conveying direction wherein for each clamp pair, the spreading-out device has a synchronization sensor for monitoring the position of a second clamp of the clamp pair, in order to ascertain whether said second clamp is located at a predetermined position offset with respect to its initial position, and wherein said second clamp is selectively disengaged or engaged from said drive means.

14. The feed apparatus according to claim 13 wherein the monitoring device comprises at least one group of at least two sensors distributed along the monitoring line.

15. A feed apparatus for feeding laundry items to a processing unit, comprising:

a feed conveyor;

a spreading-out device with at least one clamp pair comprising clamps for seizing the corners of an laundry item;

a displacement section arranged upstream of the feed conveyor in the conveying direction, said displacement section extending transversely with respect to a conveying direction and having a position measuring system for monitoring the position of at least a first clamp of each clamp pair;

drive means for displacing said clamps along said displacement section;

wherein for each clamp pair, the spreading-out device has a synchronization sensor for monitoring the position of a second clamp of the clamp pair, in order to ascertain whether said second clamp is located at a predetermined position offset with respect to its initial position, and wherein said second clamp is selectively disengaged or engaged from said drive means; and wherein said drive means comprises an elongate member which can be driven along the displacement section, and the second clamp includes a coupling device for selectively coupling the second clamp to the elongate member.

16. The feed apparatus according to claim 15 wherein the coupling device comprises a clamping part which can be displaced towards the elongate member, and an abutment arranged on an opposite side of the elongate member.

17. The feed apparatus according to claim 16 wherein the clamping part is fastened on a piston of a pneumatic cylinder.

18. The feed apparatus according to claim 15 wherein the first clamp of each clamp pair is fixedly connected to the elongate member.

19. The feed apparatus according to claim 15 wherein the position measuring system comprises a rotary encoder which monitors the position of the elongate member.

* * * * *